US005718108A

United States Patent [19]

Oppl et al.

[11] Patent Number: 5,718,108

[45] Date of Patent: Feb. 17, 1998

[54] DEVICE FOR HOLDING YARN BOBBINS WHICH ROTATE AT HIGH SPEEDS IN TEXTILE MACHINES AND ALSO TO BOBBIN ADAPTERS FOR THE SAME

[75] Inventors: Gunter Oppl; Wolfgang Schmucker, both of Hammelburg; Hermann Pickel, Schondra; Alois Knuttel, Elfershausen; Gunter Schmitt, Hammelburg, all of Germany

[73] Assignee: TEMCO Textilmaschinenkomponenten GmbH & Co. KG, Hammelburg, Germany

[21] Appl. No.: 586,006

[22] Filed: Jan. 12, 1996

[30] Foreign Application Priority Data

Aug. 16, 1995 [DE] Germany ..... 195 30 140.4

[51] Int. Cl.[6] ..... D01H 7/14

[52] U.S. Cl. ..... 57/132; 242/597.4

[58] Field of Search ..... 242/46.2, 46.3, 242/578.2, 578, 597.4, 597.6, 597.5; 57/132, 136

[56] References Cited

U.S. PATENT DOCUMENTS

| | | | |
|---|---|---|---|
| 1,898,115 | 2/1933 | Aldrich . | |
| 1,898,131 | 2/1933 | Jordan . | |
| 2,577,571 | 12/1951 | Ewing . | |
| 3,596,846 | 8/1971 | Johnston | 242/68.3 |
| 3,731,502 | 5/1973 | Stearns et al. | 68/198 |
| 4,423,609 | 1/1984 | Itoh | 68/212 |
| 4,720,986 | 1/1988 | Fuchs et al. | 68/198 |
| 4,762,179 | 8/1988 | Smith et al. | 57/129 |
| 5,154,365 | 10/1992 | Schmitt | 242/46.2 |
| 5,477,709 | 12/1995 | Rowe | 242/597.4 |

FOREIGN PATENT DOCUMENTS

| | | | |
|---|---|---|---|
| 808133 | 7/1951 | Germany | 242/597.4 |
| 1666078 | 10/1953 | Germany . | |
| 2261559 | 6/1974 | Germany . | |
| 7409733 | 9/1975 | Germany . | |
| 3132159 | 3/1983 | Germany . | |
| 3546260 | 11/1986 | Germany . | |
| 9016205 | 3/1991 | Germany . | |

*Primary Examiner*—William Stryjewski
*Attorney, Agent, or Firm*—Pandiscio & Pandiscio

[57] ABSTRACT

A bobbin adapter for a holding device for high speed rotating yarn bobbins includes a hollow cylindrically-shaped body, a spindle disposed in a central bore of the body, and at least one catch member moveable transversely of the spindle axis. The adapter is provided with a guide member on the body cylindrical wall which is moveable to engage the catch member and impart movements to the catch member toward and from the body axis. The catch member is a sliding tab mounted for movement crosswise of the body axis and is provided with a central bore disposed in part coincident with the body central bore.

9 Claims, 6 Drawing Sheets

DEVICE FOR HOLDING YARN BOBBINS WHICH ROTATE AT HIGH SPEEDS IN TEXTILE MACHINES AND ALSO TO BOBBIN ADAPTERS FOR THE SAME

BACKGROUND OF THE INVENTION

1. Field of the Invention

The invention relates to a high-speed rotating yarn bobbin for textile machines and which comprises a (drive) spindle and a bobbin adapter adapted to be fitted coaxially on the spindle with the bobbin and which comprises one or a plurality of snap-engaging means with which a snap-catch engagement constructed in or on the spindle is associated. Furthermore, the invention relates to a bobbin adapter suitable for use in the device and having a hollow-cylindrical basic body to accommodate the spindle and one or a plurality of radially movable snap-action catch means.

2. Description of the Prior Art

In the case of such prior art devices for holding bobbins (see DE-GM 74 09 733, DE-G 90 16 205.6 U1), axial locking of the bobbins on the spindles is achieved by an interlocking arrangement using a bayonet fastening. In this case, J-shaped grooves incorporated into the shaft or spindle and matching pins on the bobbin adapter provide for this interlocking arrangement. For bobbin changing, one hand is used to press the bobbin downwardly against the force of a coaxial thrust spring. With the other hand, the adapter which is disposed above is firstly introduced rectilinearly into the J-groove and then, by means of a rotary movement, the locking action is produced. If the coaxial thrust spring is structurally integrated into the adapter which is disposed above (see DE-G 90 16 205.6 U1), then during the said pattern of movements, the operator must also exert additional force to overcome the thrust spring. Above all, the need for a rotary movement during this pattern of movements is ergonomically disadvantageous, particularly because the operating staff will be required to carry out this action several times, day in and day out, in order to change the bobbins. Consequently, damage to the wrist and tendons and other serious health problems have been observed when this work is performed.

SUMMARY OF THE INVENTION

The invention is based on the problem of so further developing a holding device for yarn bobbins of the type mentioned at the outset that a rapid and easily performed bobbin change can be carried out with considerable reliability and above all in an ergonomically adapted manner or at least one which imposes the least possible physical strain on the persons concerned. At the same time, it is intended to provide a structurally simple design, a favourably costed manufacturing process and a high level of operational reliability.

By way of a solution, in the case of a holding device having the features mentioned at the outset, it is according to the invention proposed that the snap action engaging means should be mounted, guided and/or articulated in or on the adapter for movement, deflection and/or displacement in relation to the spindle axis and/or axial plane of the spindle radially, transversely and/or obliquely so that during the course of axial fitment of the adapter, its catch means come into engagement with and/or snap into the catch arrangement on the spindle in relation to the spindle axis or axial plane or the spindle in a radial, oblique and/or transverse direction. This basic concept according to the invention opens up the possibility of locking the bobbin adapter axially on the spindle by a single rectilinear movement performed when it is pushed onto the spindle. This can be carried out with one hand without the work of bobbin changing requiring any rotatory movements which can be a strain on the wrist and tendons. Operational reliability is achieved by the catches and mating catches on the spindle and on the adapter and which can easily be mechanically robustly and wear-resistantly constructed by current technology.

One possibility of realising the catch arrangement resides in constructing it as a raised portion, projection, projecting annular shoulder or as a recess, cut-out, bore or depression in the outer or peripheral surface of the spindle, whereby at least part of a pattern or a component is constructed in a radial, obliquely and/or transverse direction in respect of the spindle axis and/or axial plane of the spindle.

When fitting the bobbin adapter, in order to achieve centering, a further embodiment of the invention provides for the end part of the spindle, with which the adapter is associated, to taper preferably conically and gradually towards the end of the spindle.

In order to compensate for different lengths of bobbins which have to be changed, it is known (DE-90 16 205.6 U1) to incorporate in the adapter a spring arrangement via which adapter parts can be displaced axially in relation to one another. Thus, an adaptation of lengths can be achieved, even though writing a very limited scope. In addition, a practical possibility, according to the bobbin length, is to exchange adapters which are specifically adapted in terms of their length. This give rise to the problem of providing a holding device with an adapter which can be used for as many bobbin lengths as possible. By way of a solution and in accordance with a particular embodiment of the invention, it is suggested to provide on the spindle a plurality of catch devices which, according to the lengths of the desired bobbins, are constructed or disposed in an axially offset arrangement on the outer surface of the spindle. Therefore, in that distances between the catch elements and the spindle ends are dimensioned in accordance with prior art bobbin length graduations, so it is possible with the same adapter or the same holding arrangement to use the greatest possible multiplicity of bobbins of different lengths.

In order to resolve the problem on which the invention is based and which is mentioned at the outset, it is within the framework of the invention proposed furthermore in the case of a bobbin adapter of the type mentioned at the outset, to provide in and/or on the cylinder walls guide and/or positioning means which can be so actuated manually and/or externally that they impart to the catch means movements to and from the cavity in the basic body and/or to and from the spindle axis. In other words, the catch means are (operatively) connected to a mounting, articulation and/or guidance and which are directed at, run out at or are tangential to the spindle of the device according to the invention. Thus, a mechanism is provided which ensures in respect of the spindle axis and/or an axial plane through the spindle, a radial, oblique or transversely extending engagement of the catch means on the adapter into the catch arrangement on the spindle which is inserted into the basic body thereof.

Advantageously, one or a plurality of spring elements is/are provided which comprise at least effective components in a direction which, vis-a-vis the spindle axis and/or an axial plane through the spindle, is oblique, transverse and/or radial, the said spring elements being structurally integrated into or at least coupled to the catch means. The radially, obliquely or transversely extending axial components can thereby be so used that they impart to the catch means positioning movements which result in a snapping fitment or engagement in the catch means on the spindle.

In accordance with a particular embodiment of adapter according to the invention, this latter comprises as a catch means a sliding member which is mounted in a guide for movement at least partially crosswise to the cylinder axis and which comprises an annular tab with a central bore. Ideally, the bore in the annular tab is constructed with a larger diameter than the cavity in the cylindrical basic body of the adapter. In the locked condition, if the annular tab by virtue of its larger diameter engages eccentrically around the pushed-through spindle, then upon rotation, a centrifugal force is exerted on the eccentric or asymmetric part of the sliding member which additionally promotes the catch engagement between bobbin adapter and spindle. The use of centrifugal force-based devices for rigidly clamping bobbins on spindles in textile machines is known per se to persons skilled in the art from other technical contexts (DE-35 46 260 A1).

In order further to promote the locking or catch engagement, an additional embodiment of the invention provides a radially directed spring element as a positioning means which is braced against the basic body and which preferably presses radially outwards against the sliding member. Thus, during the course of the adapter being pushed on axially, there is an automatic snapping of the annular tab for example into an annular depression on the spindle shell which further improves the operation and handling properties as well as the ergonomic aspects.

In accordance with another embodiment of the invention, resilient hook parts, preferably disposed in a ring or crown, are provided and they have one end fixed on the basic body of the adapter. The articulation is thereby such that by virtue of the elasticity, a resilient pivoting movement of the free hook ends takes place, in each case by virtue of a recess in the inner walls of the basic body and in respect to the spindle axis and/or an axial plane through the spindle, the pivoting movement being directed radially inwardly towards the cavity in the basic body. Here, without any particular locking mechanism, engagement or catch fitment is achieved substantially by the elasticity in the hook-like spring elements and their specific disposition on the basic body of the adapter, in conjunction with the axial pushing-on movement. In order to release the hooks from their locked position on the pushed-in spindle, an axially displaceably guided releasing ring or slide is expedient, being so disposed on the inside of the hook spring element that with an appropriate sliding movement the hook part is displaced obliquely, transversely and/or radially outwardly in relation to the spindle axis and/or axial plane through the spindle.

Also conducive to simple handling is for the snap action catch elements to be constructed as rolling elements, particularly balls guided axially in or on the basic body wall and in respect of the spindle axis and/or an axial plane through the spindle with an oblique, transverse and/or radial movement and for them to be distributed over the periphery of the cylinder. At the same time, it is possible to use as the positioning means a locking ring which encloses the rolling elements and displaces them upon axial displacement to or from the catch arrangement on the spindle. Independent snap action engagement of the rolling elements can be brought about by means of a spring arrangement which moves the locking ring automatically into the catch-engagement position for the rolling elements. In accordance with a further embodiment, disengagement of the rolling elements from the catch means on the spindle is facilitated by the provision of one or a plurality of axially or axially-parallel acting spring elements. These are built into the basic body of the adapter and constitute an intermediate link between an adaptor locking part catch means and an adaptor bobbin entraining part having engaging means (for example friction surfaces) for the bobbin. Via the spring elements, locking part and bobbin entraining part can be displaced axially in respect of one another. In conjunction with the disengagement of the above mentioned rolling elements, the interposed spring elements advantageously assist their disengagement from the catch means on the spindle when the locking ring is moved into a release position.

Further details, advantages and features based on the invention will emerge from the sub-claims and from the description of preferred embodiments of the invention and the accompanying drawings in which:

DESCRIPTION OF THE PREFERRED EMBODIMENTS

Figure 1:
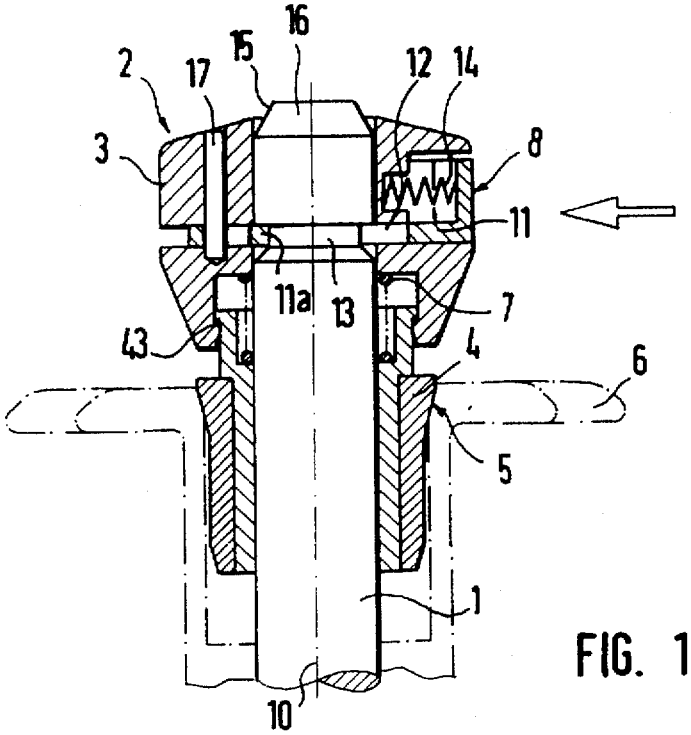
FIG. 1 shows a broken away cross-section through the upper part of a textile spindle with an example of holding device according to the invention.

In accordance with FIG. 1, the spindle 1 of a textile machine not shown in greater detail has its upper end portion pushed into the cavity in an upper bobbin adapter 2 of basically hollow cylindrical form. The upper adapter 2 consists essentially of two cohesive parts adapted for axial displacement in respect of each other, namely the upper locking part 3 and a lower bobbin entraining part 4 which in the example is constructed as a hollow-cylindrical bush with an outer wall 5 which is conical in its upper end portion. This is in frictional engagement with the oppositely disposed inner wall of a yarn bobbin 6. One or a plurality of axially parallel or coaxial thrust springs 7 which are biased against the underside of the locking part 3 press the conical outer wall portion 5 of the bobbin entraining part 4 against the inner wall of the yarn bobbin 6. The interconnection of the said parts 3 and 4 is brought about by a mutual hooking arrangement 43.

Figure 2:
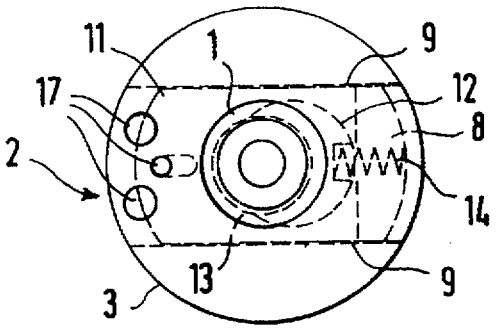
FIG. 2 is a plan or end view according to the direction II in FIG. 1.

For interlocking or catch connection of the upper adapter 2 to the spindle 1, the catch engaging means is a transverse sliding member 8 which according to FIG. 2 is displaceable in a transverse guide 9 at right angles to the cylinder axis 10 of the adapter. According to FIG. 2, the sliding member 8 has a ring-like tab 11 with a central bore 12 which engages around the spindle 1. For this purpose, the bore 12 has a larger diameter than the spindle 1. In its portion which is associated with the adapter 2, the spindle 1 has an annular groove 13 into which, according to FIG. 1, a part 11*a* of the inner circumference bounding the bore 12 in the tab 11 engages. This engagement can take place automatically during the course of the adapter 2 being pushed axially on to the spindle 1, by virtue of the transverse spring 14 which is biased against the outer shell of the basic adapter body and presses on the inner face of one flange of the sliding member 8 which has in cross-section a basically L-shaped profile. When not fitted on (not shown), the bore 12 in the tab 11 on the sliding member is displaced radially outwardly by the transverse spring 14 so that it no longer coincides with the cylinder axis 10 of the adapter 2. Fitment of the adapter 2 with the sliding member 8 is facilitated by an encircling preferably conical surface 15 constructed at the spindle end 16. The sloping surface 15 produces a centering, particularly of the sliding member 8 with its bore 12, so that the sliding member, in conjunction with the transverse pressure of the transverse spring 14, can engage the annular groove in the spindle 1. By means of one or a plurality of axially parallel fixing and/or abutment pins 17 traversing the basic adapter body and possibly also the tab 11, it is possible in addition to the supplementary arresting or locking effect also to achieve a compensation for rotary, asymmetric mass distributions in the basic adapter body. The asymmetric mass distribution can be attributed particularly to the specific construction of the transverse sliding member 8 and the asymmetric disposition of the transverse spring 14. On the other hand, the abutment and/or fixing pins 17 can perform the function of balancing members.

In the case of spindles without the aforesaid sloping surface, the correct fit-on position can be achieved by manual pressure on the outside of the sliding member 8 so that this is displaced against the radially outwardly directed force of the transverse spring 14. In order to release the interlock, the sliding member 8 is moved by sliding manual pressure radially inwardly into a release position in which the surface of the central bore 12 completely masks the cross-section of the spindle 1 or alternatively the tab 11 no longer touches the annular groove or spindle 1. The axial thrust spring 7 is then able to displace the locking part 3 axially upwardly in respect of the entraining part 4 in order to complete the locking or disengagement of the sliding member 8.

Figure 3:
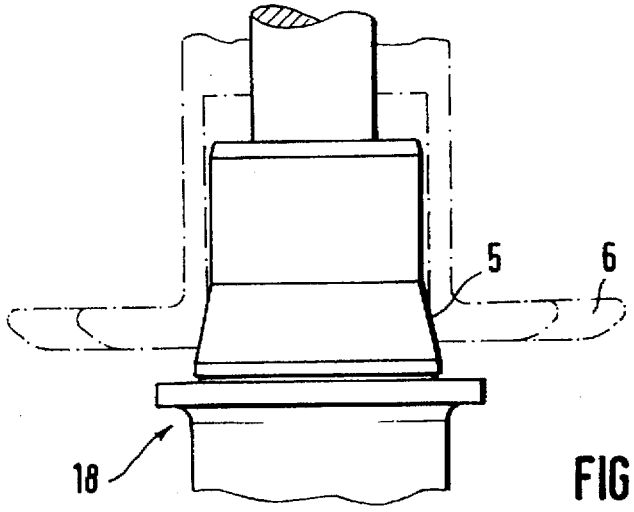
FIG. 3 is a longitudinal side view of the bottom part of the textile spindle according to FIGS. 1 and 2.

According to FIG. 3, there is at the bottom end of the bobbin 6 a bottom bobbin adapter 18 which likewise has a conical outer wall 5. The spring force of the axial thrust spring 7 according to FIG. 1 which is biased against the annular groove 13 via the engaged sliding member 8 produced a frictional closure between the conical outer walls 5 of the upper adapter 2 and the lower adapter 18 and the respective inner wall of the yarn bobbin 6.

Figure 4A:
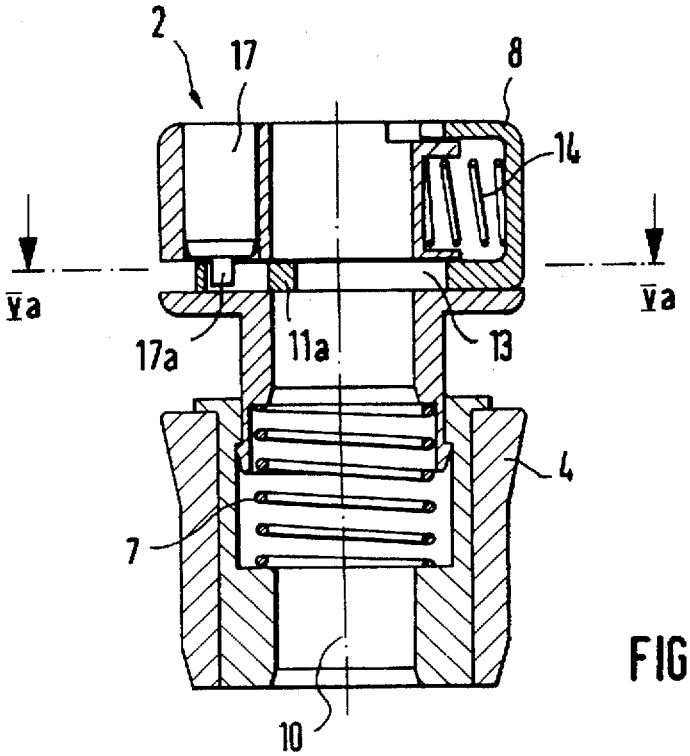
FIG. 4*a* shows in broken away cross-section the upper part of a textile spindle with a further example of holding device according to the invention, shown in the locked position.
Figure 4B:
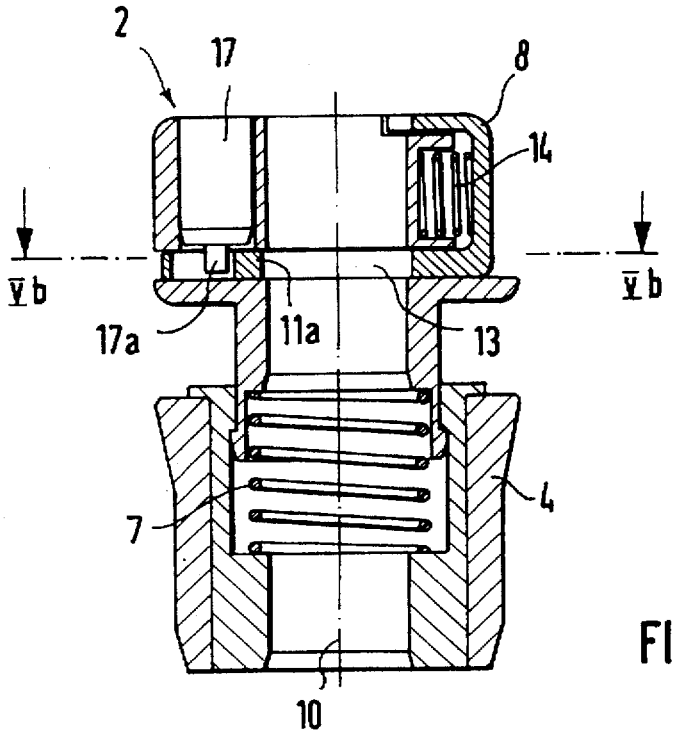
FIG. 4*b* is a view corresponding to FIG. 4*a* showing the holding device in the unlocked position.
Figure 5A:
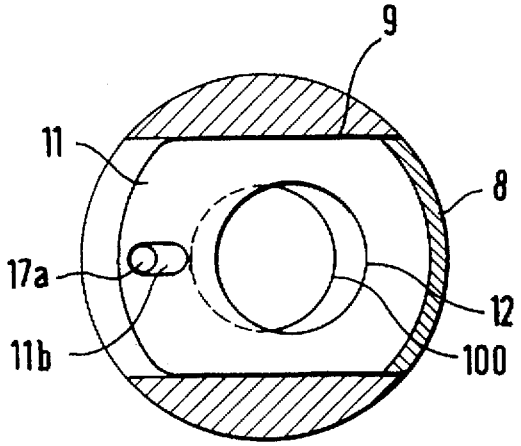
FIGS. 5*a* and 5*b* are cross-sections taken on the lines Va—Va in FIG. 4*a* and Vb—Vb in FIG. 4*b*.
Figure 5B:
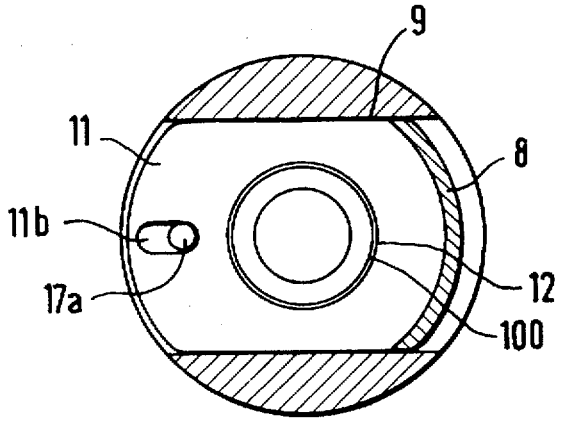

In accordance with FIGS. 4*a*, 5*a* only a single abutment and fixing pin 17 is provided which in an axially parallel manner traverses the locking part 3 of the bobbin adapter 2. At the same time, it forms a counterweight for the transverse spring 14 and the consequently radially outwardly pressed transverse sliding member 8, as can be seen particularly from the position shown in FIG. 5*a*. In this position, the catch engagement part 11*a* of the annular tab 11 has engaged the annular grove 13 and the central bore 12 of the annular tab 11 is not coincident with the maximum cross-section 100 of the spindle 1. In contrast, in the position shown in FIGS. 4*a*, 5*b*, the transverse sliding member 8 or annular tab 11 is pressed by finger pressure radially inwardly against the transverse spring 14 in such a way that the bore 12 in the annular tab 11 is coincident with the spindle cross-section 100 and the bobbin adapter 2 can be withdrawn upwardly without being impeded by any engagement or snap-fitting part 11*a* on the annular tab 11. According to FIGS. 4*a*, *b*, the fixing and abutment pin 17 has its bottom end a projecting abutment stud 17*a* which fits into an elongated hole 11*b* constructed between the outer edge and the bore 12 of the annular tab. The longitudinal direction of the elongated hole 11*b* extends substantially radially in relation to the bore 12 and/or the spindle axis 10. In the locking position shown in FIG. 5*a* the abutment stud 17*a* in the elongated hole 11*b* strikes against the radially outer end thereof while in the locked position 5*b* it bears against the radially inner end of the elongated hole 11*b*.

Figure 6:
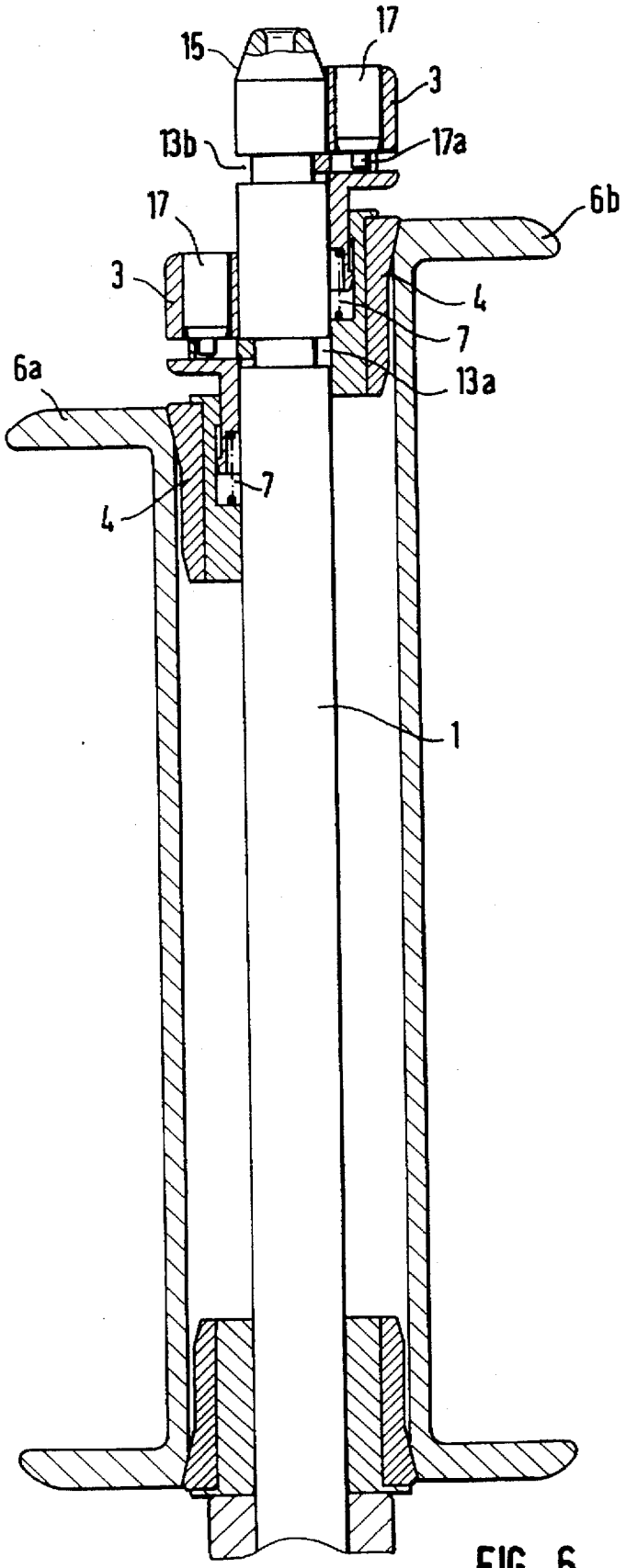
FIG. 6 is an axial partly sectional side view of a further embodiment of holding device according to the invention.

The embodiment shown in FIG. 6 makes it possible to accommodate yarn bobbins 6*a*, 6*b* of different lengths on a single spindle 1. For this purpose, the spindle 1 is provided with two annular grooves 13*a* and 13*b* at an axial distance from each other which serve as catch means. The upper annular groove 13*b*serves for axially locking the longer yarn bobbin 6*b* while the lower annular groove 13*a* serves for locking the shorter yarn bobbin 6*a*. For any other details and the mode of functioning, reference can be made to the previously explained embodiments.

Also in accordance with the further embodiments shown in FIGS. 7 to 11, only one rectilinear and axial movement 29 is needed for locking or releasing.

Figure 7:
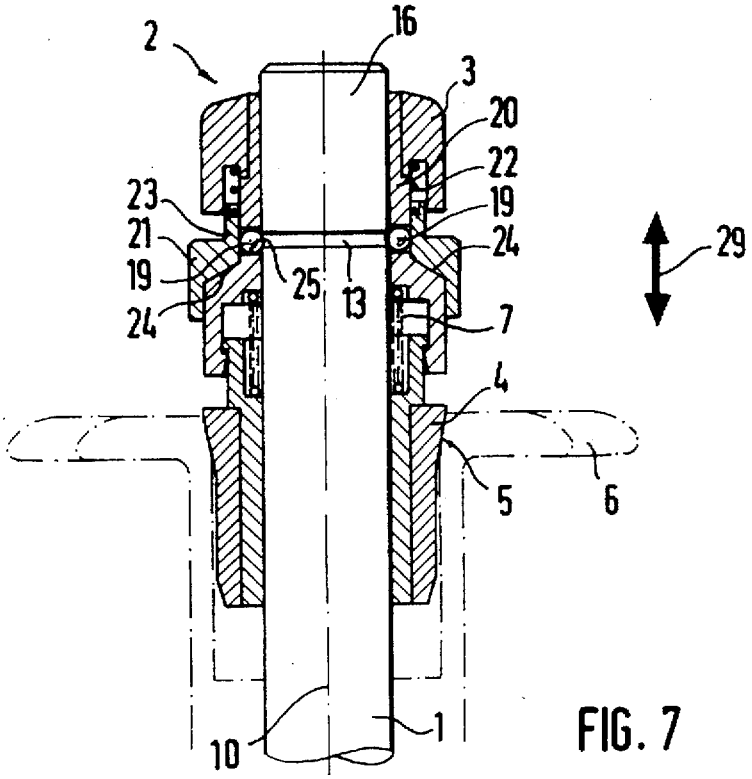
FIG. 7 is a broken away cross-section through the upper part of the textile spindle with a further example of bobbin holding device according to the invention.
Figure 8:
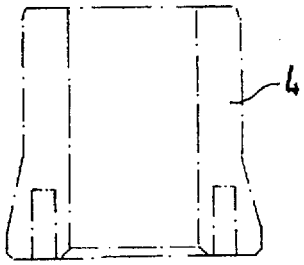
FIG. 8 shows a released bobbin adapter for the lower part of the textile spindle which is not shown in FIG. 4.

According to FIG. 7, locking takes place by means of catch means constructed as ball elements 19 in a crown or ring-like arrangement, being regularly distributed around the cylinder axis 10. In the disengaged and not locked position, the ball elements 19 are held for example in respectively associated guide pockets 20 in a corresponding annular kind of disposition and are guided directly prior to engagement in a manner axially parallel with the annular groove 13 in the spindle 1. While the upper adapter 2 is being pushed on, a locking ring 21 is pushed upwardly against the pressure of one or more axial or axially parallel locking springs 22. Thus, the ball elements 19 are no longer opposite the parallel portion 23 of the inner wall of the locking ring (parallel with the cylinder axis 10), but the polygonally following sloping portion 24 of the inside wall of the locking ring. The oppositely disposed sloping portion 24 makes it possible for the ball elements 19 to move outwardly in a radial direction so that by virtue of the force of gravity and the resulting clearance downwardly, they are capable of striking the annular shoulder 25. This lies flush with or at the same level as the bottom edge of the annular groove 13 which is disposed in a similar manner to that shown in FIG. 1. Then, the for example manually upwardly displaced locking ring 21 is released and by force of gravity and the pressure of the locking spring 22 it is moved downwards. At the same time, the parallel portion of the inside wall of the locking ring 21 bears on the ball elements 19 resulting in these engaging the annular groove 13. A radial and thus also axial movement of the ball elements 19 is thus prevented.

In order to release the interlock and the upper bobbin adapter 2, the locking ring 21 is pushed upwards again. This results in axial spring forces both by virtue of the locking spring 22 and also the thrust spring 7. In particular by virtue of this latter, the shoulder 25 is moved upwardly, the ball elements 19 being pushed out of the annular groove 13 so that they can be returned to their guide pockets 20. In addition to ease of handling, this rotationally symmetrical supporting of the bobbins provides further advantages such as simple inexpensive manufacture and avoidance of imbalance and thus centrifugal forces.

Figure 9:
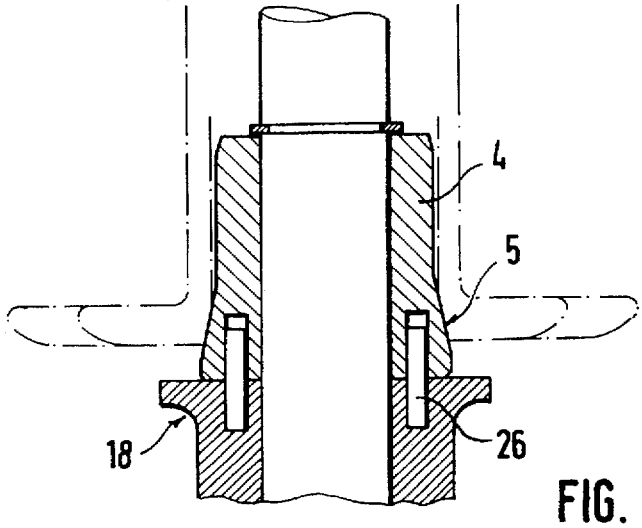
FIG. 9 is a broken away cross-section showing the bottom part of the textile spindle according to FIG. 4 with the adapter according to FIG. 5.

In accordance with FIG. 9, the lower bobbin adapter 18 is separably mounted on the spindle shaft via screw means 26. These positive connecting elements can easily transmit the force to the holding arrangement. When the friction surface of the bobbin entraining part 4 becomes worn it can easily be changed by releasing the screw means 26 as shown in FIG. 5. In the case of a support which is rigidly fitted by adhesion or pressing (see FIG. 3), this support is preferably made from two parts. In the even of wear and tear, the core remains on the shaft while an outer ring is exchanged.

Figure 10:
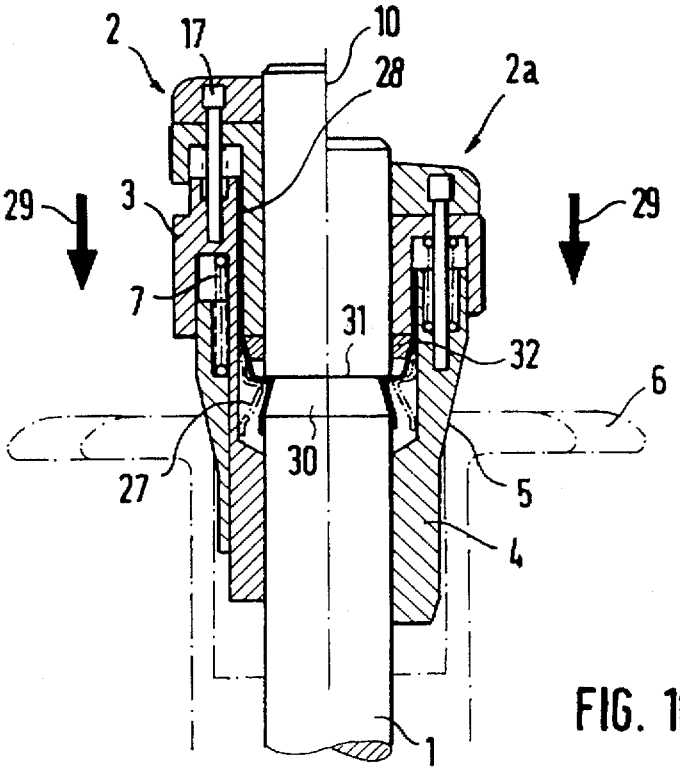
FIG. 10 is a broken away cross-section through the upper part of a textile spindle with a further example of holding device according to the invention and FIG. 11 shows a broken away cross-section through the bottom part of the textile spindle according to FIG. 7.

According to FIG. 10, the snap action engaging means are constructed as spring hooks 27 disposed in a ring around the spindle 1. Their upper shank part 28 is fixed on the inside wall of the locking part. As a result of this articulation, when a sufficient push-on movement 29 is imparted to the adapter 2 or 2*a*, the free hook part is able to snap into the notch 30 in the spindle 1. This widens out from the top edge 31 and increasingly in the direction of the spindle centre so that the top edge 31 forms an abutting hook for the free hook end of the spring hooks 27. In order to release the adapter 2 or 2*a*, a releasing ring 32 guided between spindle 1 and inside wall of the adapter 2 or 2*a*, is displaced downwardly in the direction of the notch 30. Particularly by virtue of the substantially wedge-like cross-sectional profile of the releasing ring 32, increasing displacement in the push-on movement 29 produces a widening out of the spring hooks 27 in a radially outward direction so that their free hook ends become disengaged from the top edge 31 or the mating hooks of the notch 30. In this condition, a withdrawal movement upwardly in opposition to the push-on movement 29 downwardly is possible in order to change the yarn bobbin 6.

Figure 11:
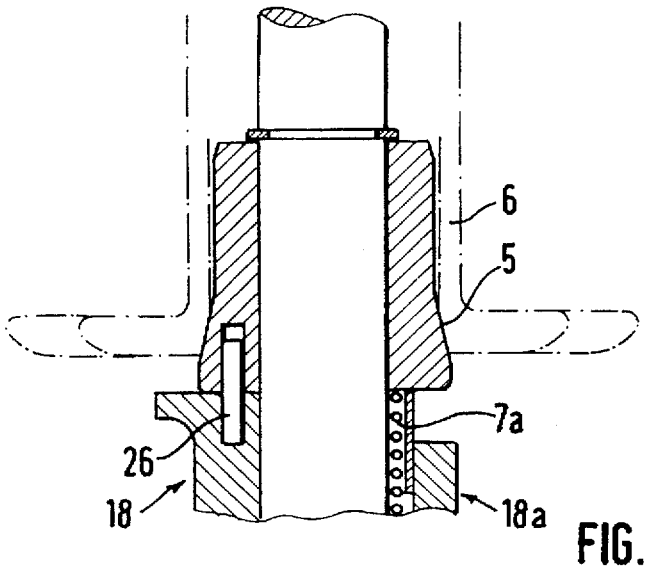

According to the left hand halves of the FIGS. 10 and 11 the axial thrust spring 7 is structurally integrated into locking part 3 of the bobbin adapter 2 and creates the axial force needed between the conical outer wall 5 and the inside of the yarn bobbin 6. According to the right hand halves of FIGS. 10 and 11, there is disposed in the bottom adapter 18*a* an axial thrust spring 7*a* having an equivalent function to produce a frictional closure between conical outer walls 5 and inner walls of the yarn bobbins 6. Then, but not necessarily, it is possible to dispense with an axial thrust spring in the upper bobbin adapter 2*a*.

We claim:

1. A bobbin adapter for a holding device for high speed rotating yarn bobbins, said adapter comprising a hollow-cylindrical basic body to accommodate a spindle and at least one snap action catch means adapted for transverse movement in respect of a spindle axis, means in cylindrical walls of the basic body operable so as to impart to the catch means movements toward and from the axis of the spindle; characterized in that said catch means comprise a sliding member mounted for movement in a guide crosswise to the spindle axis and comprises a tab with a central bore which is constructed and disposed to be partially coincident with a cylinder bore in the basic body, and further characterized by balancing members which are dimensioned and disposed to compensate for rotationally asymmetric mass distributions in the basic body, including a locking part of said basic body and a bobbin entraining part of said basic body.

2. An adapter according to claim 1, characterized by a spring element operatively connected with said catch means to cause movement of said catch means in directions transverse to said spindle axis.

3. An adapter according to claim 2, characterized in that said guide houses said spring element which is directed transversely to the spindle axis and is biased against the basic body cylinder wall, and engages the sliding member.

4. An adapter according to claim 1, characterized in that the basic body comprises a locking part in which is mounted said catch means, and a bobbin entraining part having thereon engaging means for the bobbin, said locking part and said bobbin entraining part being connected for axial displacement in respect of one another, a spring element being interposed therebetween.

5. An adapter according to claim 1, characterized in that the balancing members comprise axially parallel pins which extend through the basic body of the adapter.

6. A bobbin adapter for a holding device for high speed rotating yarn bobbins, said adapter comprising a hollow-cylindrical basic body to accommodate a spindle and at least on snap action catch means adapted for transverse movement in respect of a spindle axis, means on walls of the basic body operable so as to impart to the catch means movements toward and from the axis of the spindle; characterized in that the catch means comprise annularly disposed resilient hook parts each having one end so fixed to the walls of the basic body that free hook ends each project through a recess defined by an inside wall of the basic body radially inwardly into the recess in the basic body and transversely of the spindle axis;

and further characterized by balancing members which are dimensioned and disposed to compensate for rotationally asymmetric mass distributions in the basic body, including a locking part of said basic body and a bobbin entraining part of said basic body.

7. An adapter according to claim 6 further characterized by catch engaging means comprising an axial displaceable ring member disposed on the inside of the hook parts and slidingly movable relative to the hook parts, to engage the hook parts which are thereby pressed crosswise and outwardly in respect to the spindle axis to disengage from the spindle axis.

8. A bobbin adapter for a holding device for high speed rotating yarn bobbins, said adapter comprising a hollow-cylindrical basic body to accommodate a spindle and at least one snap action catch means adapted for transverse movement in respect of a spindle axis, positioning means on cylindrical walls of the basic body operable so as to impart to the catch means movements toward and from the axis of the spindle, said catch means comprising rolling elements which are distributed over a periphery of the spindle and are guided on the walls of the basic body axially and are guided transversely in respect of the spindle axis, characterized in that the positioning means comprise a locking ring which is disposed to engage around the rolling elements, is guided for axial displacement and comprises, disposed one after the other on an inside face which is towards the rolling elements, an axially extending portion and a portion which is inclined relative to the spindle axis;

and further characterized by balancing members which are dimensioned and disposed to compensate for rotationally asymmetric mass distributions in the basic body, including a locking part of said basic body and a bobbin entraining part of said basic body.

9. An adapter according to claim 8, characterized in that the locking ring is subject to action of one or more spring elements which are mounted in the basic body and are directed axially.

* * * * *